United States Patent [19]

Martinez

[11] 4,331,301

[45] May 25, 1982

[54] AUTOMATIC SPLICING SYSTEMS OF ROLLED BELTS OR PAPER COILS

[76] Inventor: Manuel T. Martinez, Sancho el Fuerte, 21-8° Pamplona, Spain

[21] Appl. No.: 176,495

[22] Filed: Aug. 8, 1980

[51] Int. Cl.[3] ..... B65H 19/18

[52] U.S. Cl. ..... 242/58.1; 242/56 R

[58] Field of Search ..... 242/58.1, 58.2, 58.3, 242/58.4, 58.5, 56 R, 56 A; 156/502, 504, 505

[56] References Cited

U.S. PATENT DOCUMENTS 3,841,944 10/1974 Harris ..... 242/58.1
3,863,854 4/1975 Tokuno ..... 242/58.2
3,880,698 4/1975 Kawazura ..... 242/58.4
4,170,506 10/1979 Marschke ..... 242/58.1
4,219,378 8/1960 Marschke ..... 242/58.1

*Primary Examiner*—Edward J. McCarthy
*Attorney, Agent, or Firm*—Eyre, Mann, Lucas & Just

[57] ABSTRACT

The invention relates to apparatus for automatically splicing a stand-by belt to the end of the belt or coil which is running out. In the prior art devices, there is a free transverse strip of the run-out coil which remains after the splicing has occurred. In accordance with the invention, the stand-by belt is spliced and the transverse strip is cut off so as to provide a continuous belt with no free end.

7 Claims, 10 Drawing Figures

AUTOMATIC SPLICING SYSTEMS OF ROLLED BELTS OR PAPER COILS

In those facilities in which work is carried out with paper coils on a continuous belt, there is now being placed next to the coil which is being used, another stand-by coil, which in the precise moment when the finishing operation of the first one is carried out, the new coil will enter in substitution. For such purpose and in order to avoid any stopping or detention of the process, the existence of some splicing mechanisms is already known, by means of which an automatic splice is obtained between the end of the run-out coil and the beginning of the stand-by coil.

The splicers which have been known up to now have been conventionally using the joining by sticking between the paper that finishes and that which starts, with an overlapping between both so that, as soon as the product is stuck, the paper coil which is finishing is cut; in such a way that the new coil enters the process.

This solution pre-determinates that in the stuck or linkage area, there is a free transverse strip, as a sort of rim, which is defined from the previously mentioned cutting line until the beginning if the linkage by sticking; said free rim in all the manufacturing facilities which have been known up to now, did not pre-determinate any damaging characteristic, but with the appearance of new advances within this field it has been observed that said free rim originates an important problematic point.

In fact, in the installation used for the manufacture of ondulated cardboard, what has generally been applied is the passing of the belt between toothed rollers which confer same the characteristic ondulation for later on passing the ondulated belt between one of the above mentioned rollers and another glue-applying roller, in such a way that the peaks of the ondulations will receive the necessary amount of adhesive, for placing the pertinent exterior flat sheet.

So, from the confluence or gearing area, between said toothed rollers and the part where the already ondulated belt emerges with the pertinent adhesive, a space is limited, in which it is necessary to maintain said ondulated belt, duly positioned in relation to the pertinent toothed roller, for which, arched guides were being used which adequately circumscribed in this part the above mentioned roller.

In a latter technological advancement, the function of these arched guides has been substituted, by means of the determination of a vacuum inside this roller, in such a way that by means of some radial conduits which communicated with its periphery, a sort of sucking action was established of the already ondulated paper belt, with which same remained perfectly maintained in its positioning, without requiring at all the cooperation of the above mentioned guides.

With all this and apart from suppressing the assemblage of the guides a perfect adaptation of the paper sheet is attained, thus obtaining on said belt, a sinusoid without any sort of crushings at its peaks, with which the resistance of the ondulated cardboard which is obtained at the end of the process was increased, or, on the other hand, resistance values equal to the conventional ones could be obtained, but by using a type of paper of a smaller substance.

This vacuum solution, even though it offered some important advantages, was found in its utilization, with an important problem arising from the existence of the above mentioned free rim, as the sucking action which is obtained with said vacuum does not reach same, which originated faulty portions and consequently rejection of the finished product, just in the areas of the splicings of the coils, as well as an even more important problem which is that of stickings and consequent stoppings of all the process.

This is why the achievement of a splicer has been studied which will enable one to obtain the linkage between the paper that is finishing and the one which is starting, without leaving any rim or free portion, with the outcome of this study being the solution which is being mentioned herein, with which, not only does the above mentioned basic point be attained, but also the reliability and the toughness of the splicer are increased, greatly reducing its maintenance requirements.

As per all the above and in accordance with the previously mentioned points, the splicing system comprehends the assemblage upon two close and parallel shafts, which have identical structures, of which, one of them remains in relation to the paper belt of the coil which is reaching its end and the other with that of the coil which begins, for at a given moment, turn said structures, as per a pre-established sequence, and through braking and cutting means, giving way to the pertinent splicing and cutting of the belt which is reaching its end, for later on turning both structures, but now being separated, until it is necessary to carry out another splicing operation.

Following the invention and in order to obtain what has been previously mentioned, there are connecting rods placed upon the two parallel shafts mentioned above which support the pertinent extruded parts of the paper cutting blade, as well as a front rubber element, for paper braking, which remains between this rubber element and the front of the extruded part of the other structure.

In order to get the rubber elements to attack the paper belt with the maximum possible surface and frontally, the extruded piece which carries each one of these elements, is balanced on the support piece of the connecting rod by means of a pneumatic damping chamber, thus obtaining a unform pressure of the paper between said rubber elements, at the moment of the splicing.

In order to carry out the pertinent cutting of the paper belt of the used coil, after the splicing, and in order to obtain a safe and efficient cut, the system uses a paper retention unit and at the same time tightens same. This unit is constituted by a support which determinates inclined surfaces, as per a finishing touch like a point converging towards the blade, with the surfaces bearing in a solidary way rubbers which press the paper, obtaining its necessary retention and tensioning, a unit which is adjustable in order to adapt itself to the different possible paper thicknesses and even to the nature of the material which supplies the machine.

Another characteristic of the system appears in the solution of the blade that both present identical structures, both as regards the execution of said cutting means as well as in the obtained cut itself.

In fact, each blade is housed within the extruded piece of the pertinent structure, with said blade being determined by a strip with inclined and parallel cutting protuberances, which are laid out in regular way, with each blade being related at least with one drive cylinder, having at the same time some grooves, whose configuration, corresponding to some fixed pins incorporated within same establish that in the performance of said cylinder, there will take place and advance and appearance of the blade, with its salients giving way to a perfect cut of the paper belt.

The development of all the splicing process is verified in the following manner: whilst one of the coils is under operation, remaining in relation with one of the two identical splicing structures, it is prepared on the other structure the end of the paper of the new coil, for which, once this end has been tensioned, it is provided with the pertinent adhesive means, cutting off the surplus end portion.

As soon as the new coil is prepared and at a pre-established finishing moment of the other coil, some conventional command means issue the pertinent order so that these identical structures will automatically turn one towards the other, as per the pertinent sequence, thus producing the braking or stopping of the paper, the sticking of the end of the paper of the new coil to the paper of the used one and at the same moment the cutting of the free end of the used paper by means of the blade of the pertinent structure; in the meantime the machine keeps on supplying paper as, during the braking and sticking processes, a pinch roll which cooperates as a paper guide moves in the direction which shortens the travel of same in a length equivalent to the time which the sticking and cutting processes of the new coil take; with which the machine during this period of time keeps on operating normally.

As soon as the sticking and cutting operations have been carried out both structures are automatically separated with the new paper coil coming into operation, which is duly guided by a roller of the structure which may apply.

For a greater understanding of the invention, we are now going to refer to a non-limitative example of the practical realization of same, taking as a reference the enclosed drawings, in which we have the following:

1.—System
2 and 3.—Connecting rods or structures
4 and 5.—Shafts
6 and 7.—Rollers
8,9,10 11.—Sections
12 and 13—Pneumatic cushions
14 and 15—Blades
16 and 17—Elastic joint
18—Paper belt
19—Roller
20—Paper belt
20'—Adhesive on both faces
21—Vacuum chamber
22—Elastic element
23—Support
24—Threaded rod
25—Elastic element
26 and 27—Laminar linings
28—Sheets of resistant material
29—Cylinder
30—Pin
31—Groove
32—Rod
33—Piece connected to the cylinder (29)
34—Transverse groove
35—Teeth
36 and 37—Geared rollers
38—Flat sheet
39—Arched guides
40—Adhesive applying roller
41—Dossification roller
42—Free portion
43—Radial conduits The object of the present invention are some improvements inserted in automatic splicing systems of rolled belts or paper coils, a splice which is made for linking the end of a paper coil which is finishing with the beginning of a new coil.

Figure 1:
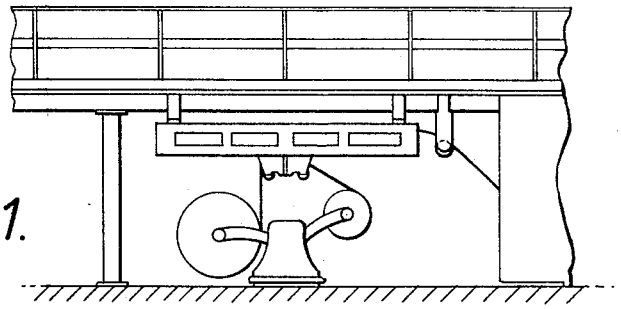
FIG. 1 shows a schematic and side view in which an installation has been represented, outstanding in a thick line the pertinent coils, both used and new, as well as upon same, the ensemble which form a splicing mechanism.

In order to attain this splicing, some solutions are already known which consist in the location of the new coil, together with the one that is being used, and to the use of a splicing mechanism which is located upon same, as can be seen in FIG. 1 of the enclosed drawings, so that for at a pre-established moment and when the end of the coil which is being used is reached, there will take place, through this mechamism, the pertinent sticking of the strip of paper of the coil which is finishing, with the beginning of the new coil.

Figure 2:
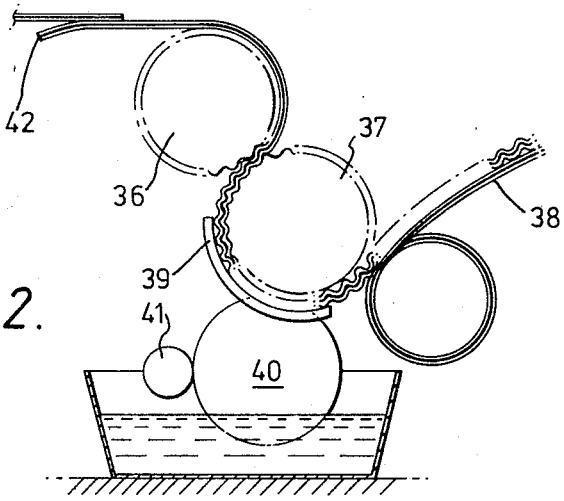
FIG. 2 is a very schematic view which shows the manufacture of ondulated cardboard.
Figure 3:
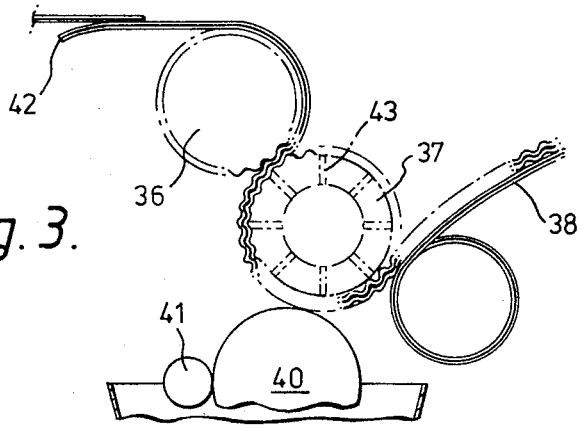
FIG. 3 is a view similar to that of FIG. 2 but with the present vacuum system, in relation to the roller (37).

In this splicing by sticking it is necessary to establish the cutting of the old coil, with which between this cutting line and just the beginning of the sticking area, a portion of paper is defined which is left either loose or free, with this portion, which with reference (42) is shown on FIG. 2 of the enclosed drawings.

This portion (42) which is free or loose, even though up to now it was not the motive of any sort of prejudice, with the appearance of new machines, it assumes nowadays an important problematic.

In fact, in the manufacturing process of ondulated paper, which is schematically represented on FIG. 2 of the enclosed drawings, the use of geared rollers is being applied (36 and 37), through which the paper belt is passed, which thus obtains the characteristic ondulation, for later on and by means of an adhesive applying roller (40) and its dossifier (41), provide the peaks of the ondulations with the necessary amount of adhesive for the sticking of the final flat sheets (38).

This paper belt, once it is ondulated by its passing through the rollers (36 and 37), must be maintained in close contact in relation to the shapes of the latter, for which, there were being used, as can be seen on FIG. 2, some arched guides (39) which thus retained the paper belt.

In a latter technological advancement, the functions of these arched guides (39) were substituted by means of the determination of a vacuum within the roller (37), a vacuum which through radial conduits (43) communicated with their periphery, originated a sort of suction action which kept the belt in close and perfect contact in relation to said roller (37).

This solution, apart from simplifying the execution of the ensemble, offered some additional advantages which have already been commented at the beginning of this memoire, as regards the achievement of a more perfect sinusoidal shaping on the paper belt; all of which advises the use of this installation, in view of which appears as an inconvenience, the existence of the previously mentioned free portion (42) of the paper belt at its splicing zone.

In fact, this free or loose portion (42), upon arriving to the roller area (37) cannot be kept in close contact in relation to said roller (37), thus remaining unproperly positioned, which gives way to the appearance of a faulty zone in the final product, and also, as a more serious problem, analogous obstacles will appear in the operation of the assembly, which will even give way to the stopping of the process.

In order to avoid all this problematic situation, a new system has been sought, by means of which said free portion (42) shall be made to disappear, with the result of said search being the solution mentioned now, by means of which said free portion (42) is eliminated, apart from obtaining a splicing system of a greater operative toughness and reliability, in which maintenance is reduced to the minimum.

Figure 4:
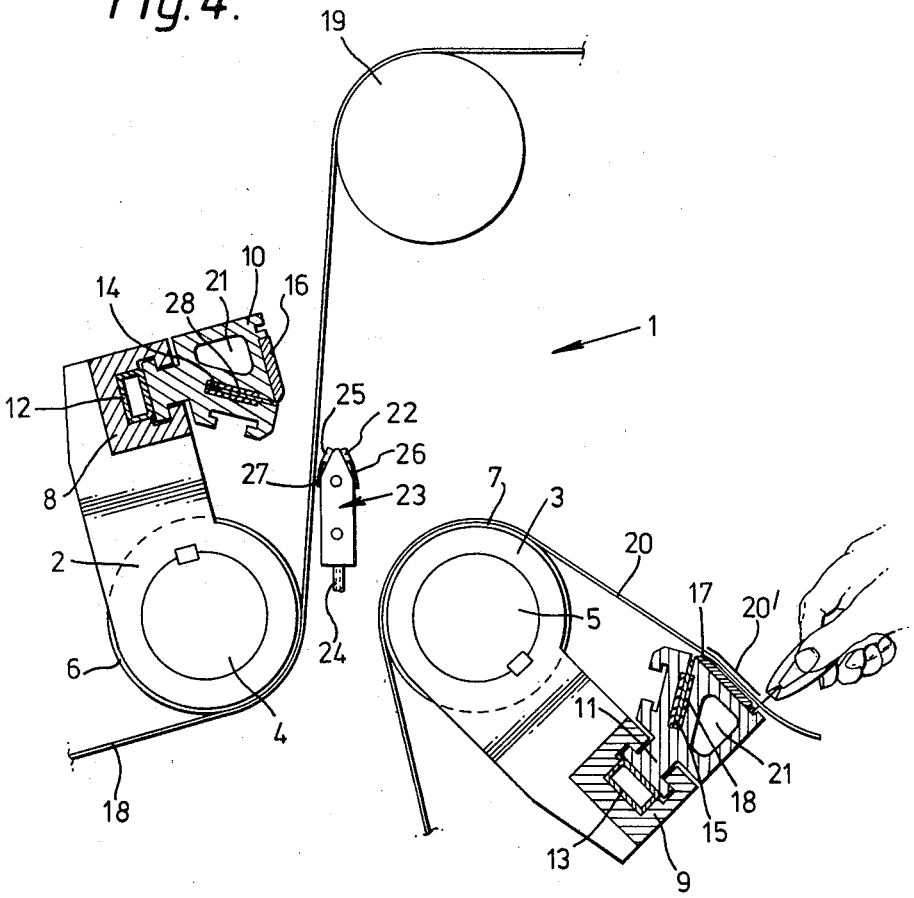
FIG. 4 is a side view and partially sectioned, in which the basic part of the mentioned system has been schematically represented, with one of the paper coils being under operation and in the preparation stage of the new coil.

For this, as can be seen in FIG. 4, the system is constituted by identical structures, mounted upon the pertinent paraaxial shafts (4 and 5), with an adequate possibility of rotation.

These identical structures are determined by pairs of connecting rods (2 and 3), which are placed on the ends of the shafts (4 and 5), having some rollers mounted between same (6 and 7) which rotate freely permitting the guidance of the paper.

There are sections (8 and 9) mounted upon two pairs of connecting rods, which at the same time provide some sections (10 and 11), laid out as per a floating assemblage, by means of some pneumatic cushions (12 and 13), which consist in rubber tubes which are plugged up at one of their ends and fed with compressed air through the other end. These pneumatic cushions (12 and 13), as can be seen on FIG. 4, are located between the sections (8 and 10) and sections (9 and 11), which, in conjunction with the pertinent plays which are limited amongst same, provides the previously mentioned floating assembly of sections (10 and 11).

The above mentioned sections (10 and 11), also present some cutting media which are basically constituted by blades (14 and 15) respectively, which can slide between some wear resistant sheets (28).

Also, said sections (10 and 11) have solidarily along their entire length elastic edges (16 and 17), respectively, which, as can be seen further on, provide a shock absorption of the impact between both identical structures, when the moment of the splicing takes place.

Once these general principles in the constitution of basic elements which form the system have been seen, the development of same can be described, as per the following points:

Firstly and whilst a paper coil is being used, its belt (18) shall be moving being guided by the rollers (6 and 19), respectively. The new paper belt (20) pertaining to the coil which will replace the first one when it finishes, is guided, by means of roller (7) and supported upon the elastic edge (17), laying it out in such a way that it is perfectly tensioned and aligned in relation to belt (18).

The paper belt (20), is kept in close contact upon the elastic edge (17), by means of the most convenient method, as could be the determination of a vacuum inside the chamber (21) communicated with the edges (17 and 16), or either the use of an adhesive which can be applied in the "spray manner" upon the edge (17), or by means of any other analogous solution.

As soon as the paper belt (20) is thus adhered to the elastic edge (17), the surplus end of same is cut manually, as is shown on FIG. 4, in which it can be seen how the sections (10 and 11), have a groove along their entire length, which facilitates said cutting operation.

Figure 5:
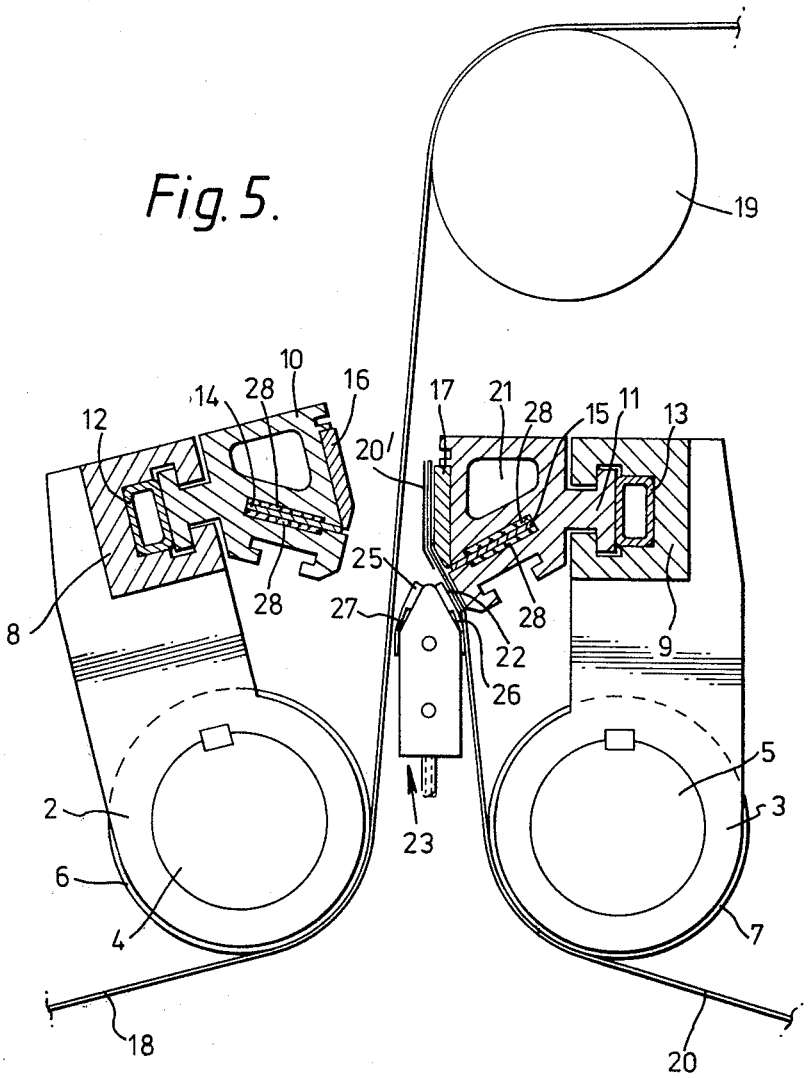
FIG. 5 is a similar view to the above, but with the structure pertaining to the new coil already rotated to a waiting position, for immediate splicing.

A double face adhesive (20') is placed upon the portion of the paper belt (20) which remains adhered to the elastic edge (17) and the connecting rods are turned (3) until the section (11) stops against an elastic element (22), with the paper belt thus being (20) strongly pressed as can be seen in FIG. 5. In this way everything is ready for initiating the splicing cycle at the desired moment.

Figure 6:
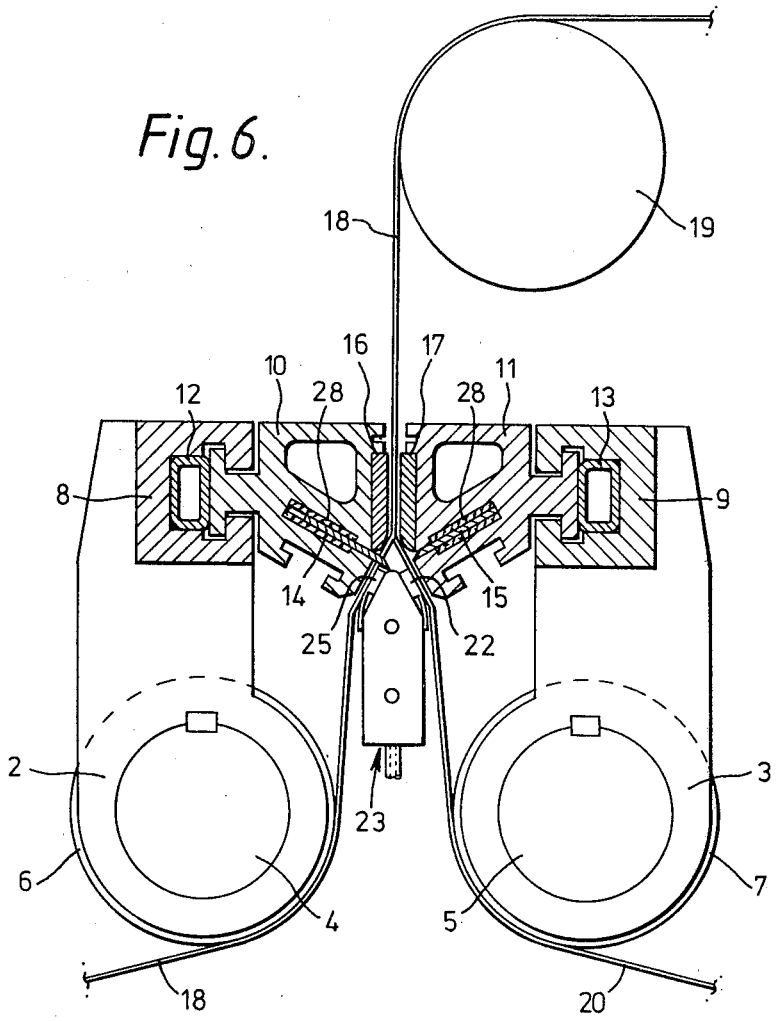
FIG. 6 is a view just like the previous ones, but with the splicing of the coils already being carried out and the cutting of the final end of the used coil.

The splicing or linking process between both paper belts (18 and 20) is developed as follows:

Shaft (4), see FIG. 6, rapidly turns originating a strong impact between the elastic edges (16 and 17), trapping between both the old paper belt (18) and at the end of the belt (20), upon the area of the adhesive (20'). Then the cutting element (14) is put into operation cutting the old paper belt (18), at the part under the sticking and linking area between both paper belts (18 and 20) as can be seen on FIG. 6.

Figure 7:
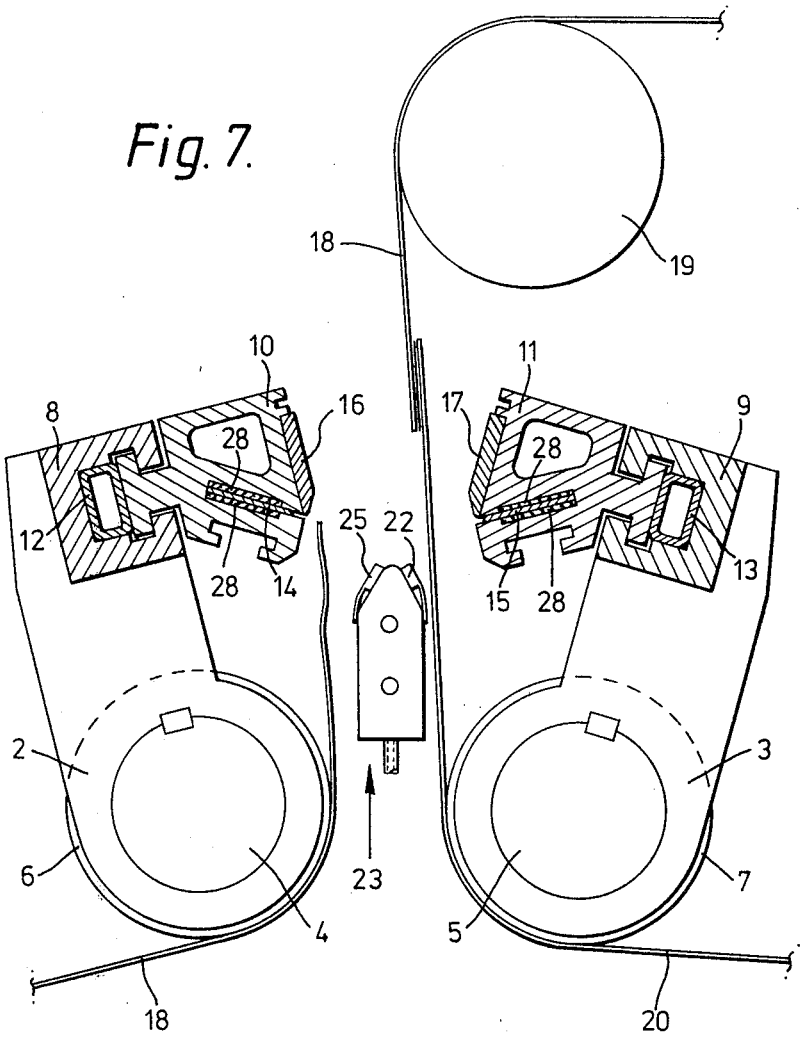
FIG. 7 shows the usage of the new paper coil and the withdrawal of the old coil which is already cut.

On FIG. 7, it can be seen how once the blade (14) cuts the paper belt (18), shafts (4 and 5) rotate in the opposite direction, leaving free the new belt (20), already stuck upon the glue of the old belt (18), as per a perfect splicing in which there are not the already mentioned free rims or portions.

As soon as this splicing has been verified, the paper belt would be used (20) if the new coil, proceeding to withdraw the old coil and to position a new replacement one in its place, in such a way that all the operations which have previously been described and which were carried out upon the section (11), will now be carried out on section (10), leaving the assembly ready for a new splice, when same is necessary.

The elastic element (22), is laid out upon a support body (23) which also incorporates another elastic element (25), so that in the previously mentioned process it will maintain the old paper belt (18) duly stretched and tensioned, as can be seen on FIG. 6; thus making the cutting of same be easier.

Both elastic elements (22 and 25), are mounted upon respective inclined surfaces which converge towards the upper area, having provided the lining of same by means of some laminar bodies (26 and 27) of a synthetic nature, but which are more wear resistant than those. It has also been foreseen that the body of the support (23) can have its positioning adjusted, in order to adapt itself to the different paper thicknesses or to analogous condition for which, this body can be constituted, as per a constitution in the form of elastically deformable elastic strips, or as is shown on the enclosed drawings, with a rigid constitution but with a lower threaded element (24), which will permit said adjustment, or by means of any other analogous solution which will make it feasible.

On the other hand, floatability between sections (8 and 10) and section (9 and 11), makes the pressure between the adhesive and the two paper joints to be uniform in width and along all the sticking area, compensating flection by impact in the central part between the supporting points.

Figure 8:
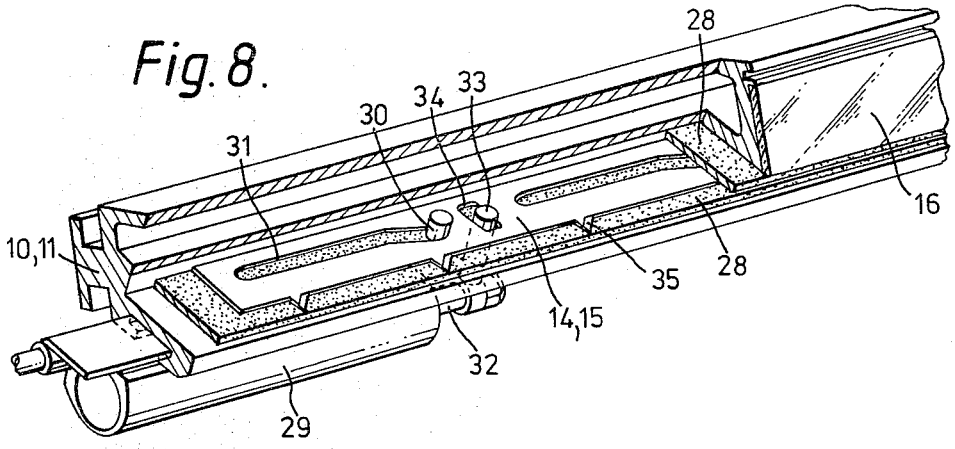
FIGS. 8, 9 and 10 are perspective views and partially sectioned, which show the solution of a cut incorporated by the system, with the blade (14) or (15) taking up different possible positionings.

Another peculiarity of this invention is based upon the principle of the cutting system, which is the following:

on FIG. 8, a section of the cutting system can be seen, which consists of section (10 or 11), on which both sheets (28) of wear resistant material are mounted, and through these sheets (28) the blade can slide (14 or 15) actuated by a cylinder which is mounted upon section (10 or 11) respectively.

On the other hand there is a fixed pin (30) which is inserted in a groove (31) of the blade (14 or 15); said groove (31) has an initial area of sharp obliquity and from same, another longer one which presents a very slight inclination.

Upon rod (32) of cylinder (29), there is a piece connected (33), from which, from one of its ends penetrates into a groove (34) of the cutting blade (14 or 15).

Figure 9:
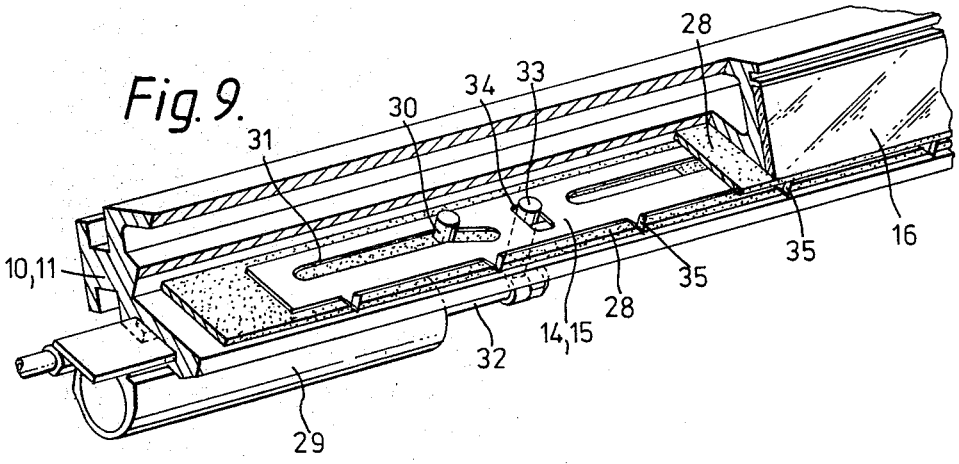
Figure 10:
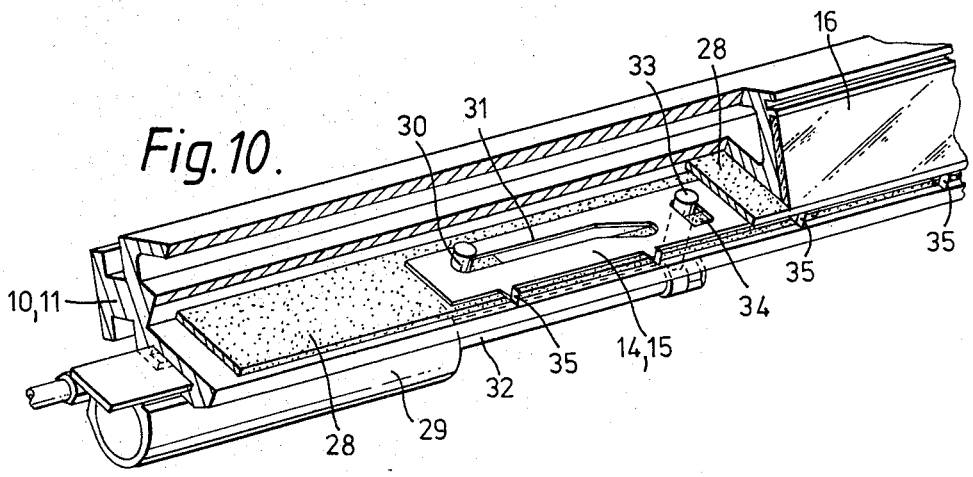

Thus, when the cylinder (29) is actuated, the part (33) moves taking along with itself the blade (14 or 15) which, guided by the pertinent number of pins (30) which would exist along the entire section (10 or 11), will follow a course equal to the section of the grooves (31), in such a way that in the rest position, shown in FIG. 8, the teeth (35) of the blade (14 or 15), are hidden between the two sheets (28), but upon passing to the position shown in FIG. 9, which corresponds with the end of the most steep area of the grooves (31), said teeth (35), come out from their hidden position.

In this position, shown in FIG. 9, all the teeth (35) have perforated the paper, in such a way that when the blade continues its displacement (14 or 15) these teeth (35) cut a sector of paper pertaining to each one of them, as the length of the groove (31) is greater than the distance between every two of these teeth (35) see FIG. 7.

Thus, with a small displacement of the blade (14 or 15), big paper widths can be cut.

It is to be pointed out, that the small inclination that the longest part of the groove represents (31) establishes that the advance of the teeth (35) will be simultaneous with a progressive appearance of same, in such a way that with it is established that all the sharp side of the teeth (35) will actuate in each cut, thus avoiding localized wear at concrete points.

As is logically understood, this cutting system permits the axial effort of the blade to be increased, varying the characteristics of the cylinders (29) or increasing the number of same, always when the resistance of the material to be cut should so require it.

On the other hand it has to be pointed out that this splicing system can be perfectly valid for working upon groupings of coils, always when the coils that are being used are mounted upon a same shaft, and at the same time, the new coils shall also be located on a same shaft. In fact the adaptation of the system to a multiple installation of this type would only require the adequate increase in length of shafts (4 and 5) and to have upon them the necessary assemblies of the already mentioned structures in accordance with the number of coils of the installation, in such a way that it would also be feasible to have a synchronization of all the structures, in such a way that a splice would take place at the same moment and for all the coils, or either this splicing can independently take place for each pertinent couple of coils, as each couple of identical structurations can carry out by itself the functions of preparation, braking, sticking and cutting.

I claim:

1. Apparatus for splicing a free end of a first belt from a rolled coil to a second belt of an operating coil for forming a continuous belt comprising:

(a) first and second shafts having first and second rollers mounted respectively thereon for receiving said first and second belts therebetween and for guiding said belts thereon;

(b) first and second sections respectively rotatably mounted on said first and second shafts;

(c) each said section including a floating assembly floatingly mounted thereon, said floating assembly having an elastic edge thereon;

(d) each said floating assembly being disposed on the corresponding section such that when said sections are rotated relative to one another, the elastic edges of said floating assemblies are impactingly abuttable whereby the belts are trapped between said elastic edges for adhering said first belt to said second belt; and (e) first and second cutting means disposed respectively on said floating assemblies for cutting an end of said second belt of said operating coil at a point adjacent said elastic edges whereby there is no free portion of said second belt remaining after affixing said free end of said first belt.

2. The apparatus of claim 1 wherein said floating assemblies are coupled to their corresponding sections by pneumatic damping chamber means whereby pressure between said elastic edges upon impacting abutment thereof is uniform along the surfact contact.

3. The apparatus of claim 1 further comprising means for retaining a paper belt against said elastic edges.

4. The apparatus of claim 3 further comprising a groove on each said floating assembly adjacent said elastic edge for guiding the trimming of the paper belt retained against said elastic edges.

5. The apparatus of claim 1 further comprising an elastic element arranged opposite said cutting means for maintaining said old paper belt stretched and tensioned for cutting upon said impacting abutment of said elastic edges.

6. The apparatus of claim 1 wherein said first and second cutting means include a blade having teeth thereon, said blade being slidably disposed between two sheets wherein said teeth are normally hidden, and which upon actuation of said blade said teeth are exposed for cutting of the second belt.

7. The apparatus of claim 6 wherein said blade is grooved and fits upon corresponding pins such that said teeth move quickly outward from said sheets during an initial advance of the blade and more slowly thereafter whereby the advance of the teeth is simultaneous with the progressive appearance of the teeth, the entire sharp edge of each tooth thus being utilized in each cut.

* * * * *